United States Patent [19]

Korte et al.

[11] Patent Number: 4,965,875

[45] Date of Patent: Oct. 23, 1990

[54] FLOURESCENT LAMP

[75] Inventors: Heinrich Korte, Ihrhove; Theo Spix, Oldenburg, both of Fed. Rep. of Germany

[73] Assignee: Korte-Licht, Ihrhove, Fed. Rep. of Germany

[21] Appl. No.: 123,063

[22] PCT Filed: Jan. 31, 1987

[86] PCT No.: PCT/DE87/00039

§ 371 Date: Feb. 22, 1988

§ 102(e) Date: Feb. 22, 1988

[87] PCT Pub. No.: WO87/04771

PCT Pub. Date: Aug. 13, 1987

[30] Foreign Application Priority Data

Feb. 3, 1986 [DE] Fed. Rep. of Germany ..... 3603264

[51] Int. Cl.[5] ..... F21S 3/00

[52] U.S. Cl. ..... 362/217; 362/260; 362/362; 439/226

[58] Field of Search ..... 362/217, 260, 220, 222, 362/223, 362, 457, 226, 374, 375; 439/226, 239, 696, 602

[56] References Cited

U.S. PATENT DOCUMENTS

| | | | |
|---|---|---|---|
| 2,227,739 | 1/1941 | Pollard | 362/217 |
| 2,871,455 | 1/1959 | Richardson | 362/221 |
| 3,283,144 | 11/1966 | Rogers | 362/221 |
| 3,819,923 | 6/1974 | Schumacher | 362/226 |
| 3,908,120 | 9/1975 | Greene | 362/457 |
| 4,045,665 | 8/1977 | Williams et al. | 362/223 |
| 4,130,860 | 12/1978 | Careglio et al. | 362/217 |
| 4,443,050 | 4/1984 | Taylor | 439/620 |
| 4,460,947 | 7/1984 | Kelly | 362/374 |
| 4,477,863 | 10/1984 | Walz | 362/217 |

FOREIGN PATENT DOCUMENTS

| | | | |
|---|---|---|---|
| 0012234 | 6/1980 | European Pat. Off. . | |
| 0054595 | 6/1982 | European Pat. Off. . | |
| 0151674 | 8/1985 | European Pat. Off. . | |
| 2853379 | 6/1979 | Fed. Rep. of Germany . | |
| 3014640 | 10/1981 | Fed. Rep. of Germany . | |
| 3100920 | 8/1982 | Fed. Rep. of Germany . | |
| 8331193 | 2/1984 | Fed. Rep. of Germany . | |
| 3325840 | 1/1985 | Fed. Rep. of Germany . | |
| 3542076 | 6/1986 | Fed. Rep. of Germany . | |
| 2539485 | 7/1984 | France | 362/221 |
| 1106929 | 3/1968 | United Kingdom . | |
| 1398521 | 6/1975 | United Kingdom . | |

*Primary Examiner*—Stephen F. Husar
*Assistant Examiner*—D. M. Cox
*Attorney, Agent, or Firm*—Collard, Roe & Galgano

[57] ABSTRACT

There is provided a fluorescent lamp having a fluorescent tube and a connecting element for connection to a source of current. The connecting element includes a mains plug having contact plugs electrically connected to the fluorescent tube and projecting on one side of the mains plug. The area of the connecting element facing the contact plugs is in the shape of a housing for the fluorescent tube having an oblong shape with the mains plug located on the longitudinal side thereof.

19 Claims, 2 Drawing Sheets

FLOURESCENT LAMP

Figure 1:
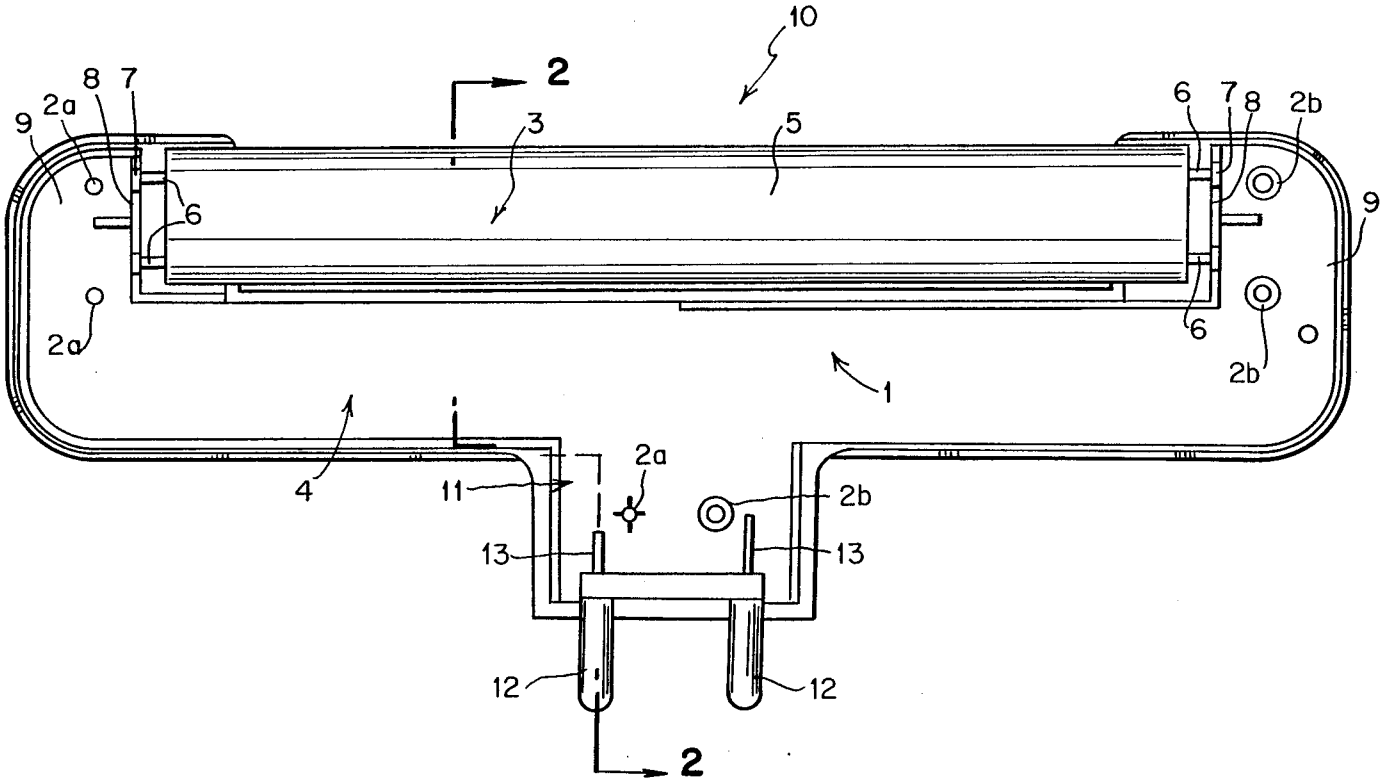

The invention relates to a fluorescent lamp having a fluorescent tube and a connecting element for connection to a source of current.

Compared with traditional incandescent bulb lamps, fluorescent lamps are being used more and more because fluorescent lamps have greater longevity and consume less energy. With fluorescent lamps it is, moreover, also possible to easily achieve desired texture of light, especially light comparable to daylight, while incandescent lighting is characterized by a yellowish hue and lower luminous efficiency which is often inadequate for purposes of illuminating working areas. For this reason, therefore, it is common, especially in working areas, and principally in large surface working areas, such as industrial office spaces, large-scale culinary facilities and the like, to install fluorescent lamps which usually take the form of banks of permanently installed overhead lighting running along the ceiling.

Given the advantages of fluorescent lamps over incandescent bulbs it would be desirable to make increased use of fluorescent lamps also in smaller spaces and to come up with more adaptable fluorescent lamp designs so that incandescent light bulbs could be replaced by fluorescent lamps even in those areas in which these incandescent bulbs are still exclusively used, for example, to illuminate nightstands, desks and similar.

The task to be resolved by the invention is to develop a fluorescent lamp which can be easily and firmly connected to the power supply in the various parts of a building.

This task is resolved by the invention, a fluorescent lamp which is characterized by a connecting element which is shaped into a housing enclosing the fluorescent tube.

The connecting element is preferably so configured that it both supplies the electrical power to the fluorescent lamp and, when plugged in, provides adequate support, thereby rendering additional means of support unnecessary. The connecting element can, for example, be a screw-in base which can be screwed into a lamp socket which functions as the electrical power source. The connecting element can also be a cable lead or any kind of connector with contact plugs. Preferably, the connecting element has the form of a mains plug with contact plugs which are connected to the fluorescent tube in an electrically conductive way and which project on one side, and the area of the mains plug which faces the contact plugs is shaped as a housing.

An advantage of the fluorescent lamp the subject of the invention is that it can plugged into an electric outlet usually available in any room. By being plugged into the outlet, the fluorescent lamp is both connected to the power mains and firmly held in place in the outlet since an area of the contact plug is shaped as a housing and encloses the fluorescent tube. The fluorescent lamp is immediately ready for use, and additional supports on the fluorescent lamp, on the walls or ceilings of the room in which the lamp is used, are thus eliminated to advantage.

Preferably, the contact plug has the form of a flat plug, also called a Euro-plug, so that it will fit any kind of electric outlet, in particular, when traveling, an outlet conforming to different electrical standards, e.g., in a hotel room.

The housing, in a preferred embodiment, assumes the shape of the fluorescent tube and is oblong and the mains plug is located on the longitudinal side of the housing, projecting Vertically from this longitudinal side such that minimum mechanical forces act on the contact plugs and mains plug which give the fluorescent lamp its firm support when it is plugged into the outlet.

In a preferred and especially convenient embodiment, the housing is approximately 17 cm in length, about 4 cm wide and 2 cm high.

So that the housing can be easily assembled, the fluorescent lamp tube easily replaced, the wiring required to operate the fluorescent lamp installed during fabrication and, following operation of the fluorescent lamp, repaired if necessary, the housing preferably consists of two separable half-shells. To enable particularly easy and cost-effective manufacture of these two half-shells and to ensure especially easy assembly, and, in particular, by technically inexperienced individuals, both half-shells are identically shaped so that they are interchangeable. The contact plugs are preferably arranged in the junction plane of both half-shells so they, and other parts of the mains plug are accessible when the housing is opened up. Injection molded half-shells, preferably made of plastic, can be especially cost-effectively produced.

In accordance with a preferred embodiment of the housing, both half-shells which make up the housing are easily united by joining the two halves together, which halves have internal notched elements which, when the housing is assembled, engage the matching notched elements of the corresponding other half-shell.

In accordance with another embodiment of fluorescent lamp, the interior space of the housing has the form of two contiguous sleeves which extend in a direction parallel to each other. The first sleeve houses the fluorescent tube; the second, the electrical wiring needed to operate the fluorescent tube, and the mains plug is tip-stretched on the longitudinal edge of the second sleeve which faces away from the first sleeve.

The fluorescent tube and the wiring required to operate the fluorescent tube can be compactly and easily accomodated in, and removed for replacement from, both sleeves which extend in a direction parallel to each other. The housing has preferably only approximately double the volume of the fluorescent lamp tube, thus making the fluorescent lamp handy in size and so lightweight of its ownself that it rests firmly connected in and to the outlet. The mains plug is tip-stretched on the second sleeve which contains the wiring, such that short contacts enable the contact plugs to make electrical contact with the wiring and the fluorescent lamp tube points away from the electrical outlet and in the direction of the room to be lighted when the fluorescent lamp is plugged in.

The shape of first sleeve has been adapted to fit the fluorescent lamp so that the fluorescent tube can be inserted into this first sleeve and is held in the first sleeve without slack. To enable the fluorescent lamp tube's light to emerge from the housing, the first sleeve has a recess in its side which serves as a window for the fluorescent lamp tube, which recess preferably stretches over the entire central wall area of the first sleeve. Preferably, the recess is covered with a covering or an insert, made of translucent plastic, for example, to protect the fluorescent lamp and its connecting contacts against dust.

In a preferred embodiment of the housing, the second sleeve opens out into chambers which border the front sides of the first sleeve on the outside of the first sleeve and contact vanes, providing frontal connecting contacts for the fluorescent tube, are arranged in the first sleeve, which contacts are connected to the wiring housed in the second in an electrically conductive way. The contact vanes are so arranged on the front sides of the first sleeve, that the fluorescent lamp tube makes electrical contact via its connecting contacts with the mains plug as soon as the fluorescent lamp tube is inserted into the first sleeve without its having to be connected by means of clamp connectors or similar devices. Preferably, guides may be provided in the first sleeve for the fluorescent tube's connecting contacts so that the fluorescent lamp tube can only be inserted into the first sleeve in a position in which the connecting contacts sit snugly against the contact vanes.

A practical example, from which additional characteristics of the invention will be evident, is shown in the drawings. Illustrated are:

FIG. 1 top view of a half-shell of a housing according to the invention

Figure 2:
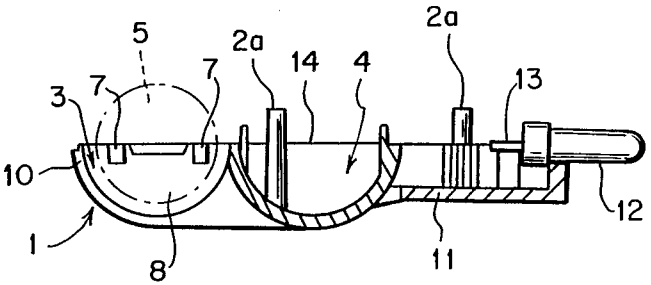
Figure 3:
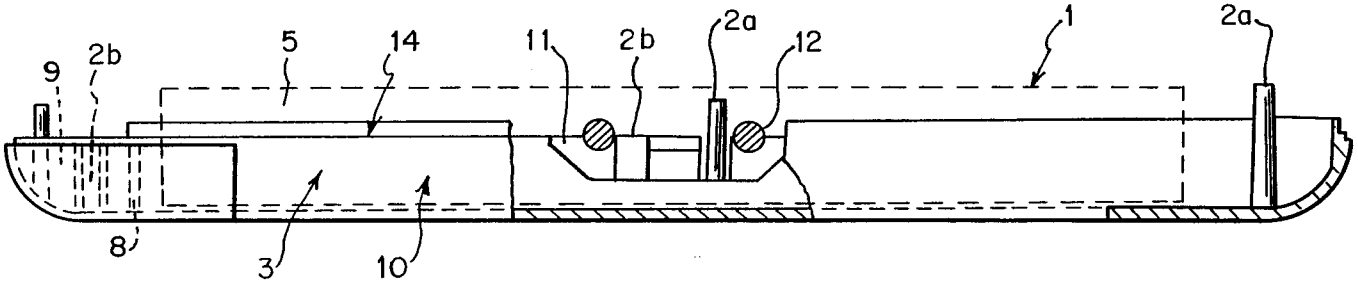

FIG. 2 a cross-section of the half-shell according to FIG. 1, along the dash-dotted line in FIG. 1 identified by II—II and FIG. 3 a partial section side view of the half-shell according to FIG. 1 and FIG. 2.

FIG. 1 shows a top view of a half-shell 1, which together with a second, identical half-shell 1 can form a connecting element which is shaped into a housing which supports a fluorescent lamp tube 5. Both half-shells 1 have notched male and female elements *2a, 2b,* by means of which the shells can be joined together.

The interior of the housing formed by both half-shells 1 is shaped like sleeves 3, 4, which extend in a direction parallel to each other. The fluorescent lamp tube 5 is inserted into the first sleeve 3, the tube having connecting contacts 6 which snugly rest against electrical contact vanes 7 provided on the front sides 8 of the first sleeve 3 and which vanes establish electrical conductive contact with the electric wiring (not shown) housed in the second sleeve 4. The second sleeve 4 opens out into chambers which border the front sides of the first sleeve, through which chambers the contact vanes 7 establish electrical contact with the wiring housed in the second sleeve 4.

In the side of the first sleeve 3 there is a recess which functions to permit emergence of light from the fluorescent lamp tube.

The connecting element passes over the longitudinal edge of the second sleeve 4 which edge faces away from the first sleeve 3 into the housing and in the practical example shown this connecting element has the form of a (power supply or light socket plug) 11 from which contact plugs 12 project, which contact plugs are connected via the leads 13 indicated in an electrically conductive way to the wiring housed in the second sleeve 4 and by means of which contact plugs said wiring is supplied with electricity when the contact plugs 12 are plugged into an electrical outlet.

FIG. 2 shows a cross-section of the half-shell 1 according to FIG. 1. Identical parts components are identified by the same reference numbers used in FIG. 1.

In FIG. 2 the interior configuration of the housing which has the shape of two parallel sleeves 3, 4 can be particularly noted. In addition, the notched male elements *2a* on the sleeve 1 can be observed, which elements project out over the junction plane of both half-shells 1. The contact plugs 12 located in the junction plane can also be observed. The fluorescent lamp tube 5 is indicated by a dash-dotted circle.

FIG. 3 shows a side view of the half-shell 1 according to FIG. 1 and 2, which side view is shown in partial section. Identical parts components are again identified with the same reference numbers as in the preceding figures.

In FIG. 3, once again, the notched male and female elements *2b* and *2a* are clearly observable. Of these elements, the male prongs *2a* project above the junction plane 14 of both half-shells. The fluorescent lamp tube 5 is indicated in FIG. 3 by a dashed rectangle.

What is claimed:

1. A fluorescent lamp comprising:

a fluorescent tube, and a connecting element for establishing connection with a source of current, said connecting element including a light socket plug having contact plugs electrically connected to the fluorescent tube and projecting on one side, said light socket plug being shaped like a flat plug and the area of the connecting element facing the contact plugs being shaped as a housing for said fluorescent tube, said housing including two separable, identical half shells.

2. A fluorescent lamp in accordance with claim 1, characterized in that the contact plugs are arranged in the junction plane of both half-shells (1).

3. A fluorescent lamp in accordance with claim 2, characterized in that the half-shells are injection molded parts made of plastic.

4. A fluorescent lamp in accordance with claim 3, characterized in that in the interior of both half-shells there are both male and female notched elements which project out over the junction plane of the half-shells (1) which elements, when the housing is assembled, engage the matching notched elements of the corresponding other half-shell.

5. A fluorescent lamp in accordance with claim 3, characterized in that the interior space of the housing has the form of two contiguous sleeves which extend in a direction parallel to each other; and further characterized in that the first sleeve having a central wall area houses the fluorescent tube; the second sleeve, the electrical wiring needed to operate the fluorescent tube, and in that the mains plug is tip-stretched on the longitudinal edge of the second sleeve which faces away from the first sleeve.

6. A fluorescent lamp in accordance with claim 5, characterized in that the first sleeve has a recess in its side which serves as a window for the fluorescent lamp tube.

7. A fluorescent lamp in accordance with claim 6, characterized in that the recess extends over the central wall area of the first sleeve.

8. A fluorescent lamp in accordance with claim 6, characterized in that the recess is covered with a translucent covering.

9. A fluorescent lamp in accordance with claim 5, characterized in that the second sleeve opens out into chambers which border the front sides of the first sleeve on the outside of the first sleeve and in that contact vanes, providing frontal connecting contacts, for the fluorescent tube are arranged in the first sleeve, which vanes, through the chambers, establish electrical contact with the wiring housed in the second sleeve.

10. A fluorescent lamp in accordance with claim 5, characterized in that the second sleeve opens out into chambers which border the front sides of the first sleeve on the outside of the first sleeve and in that contact vanes, providing frontal connecting contacts, for the fluorescent tube are arranged in the first sleeve, which vanes, through the chambers, establish electrical contact with the wiring housed in the second sleeve.

11. A fluorescent lamp comprising:

a fluorescent tube, and a connecting element for establishing connection with a source of current, said connecting element including a light socket plug having contact plugs electrically connected to the fluorescent tube and projecting on one side, said light socket plug being shaped like a flat plug and the area of the connecting element facing the contact plugs being shaped as a housing for said fluorescent tube, said housing having an oblong shape with the light socket plug being located on the longitudinal side thereof and projecting vertically from said longitudinal side, said housing including two separable, identical half shells.

12. A fluorescent lamp in accordance with claim 11, and characterized in that the housing is approximately 17 cm in length, about 4 cm wide and 2 cm high.

13. A fluorescent lamp in accordance with claim 11, characterized in that the contact plugs are arranged in the junction plane of both half-shells.

14. A fluorescent lamp in accordance with claim 13, characterized in that the half-shells are injection molded parts made of plastic.

15. A fluorescent lamp in accordance with claim 14, characterized in that in the interior of both half-shells there are both male and female notched elements which project out over the junction plane of the half-shells which elements, when the housing is assembled, engage the matching notched elements of the corresponding other half-shell.

16. A fluorescent lamp in accordance with claim 14, characterized in that the interior space of the housing has the form of two contiguous sleeves which extend in a direction parallel to each other; and further characterized in that the first sleeve having a central wall area houses the fluorescent tube; the second sleeve, the electrical wiring needed to operate the fluorescent tube, and in that the light socket plug is tip-stretched on the longitudinal edge of the second sleeve which faces away from the first sleeve.

17. A fluorescent lamp in accordance with claim 16, characterized in that the first sleeve has a recess in its side which serves as a window for the fluorescent lamp tube.

18. A fluorescent lamp in accordance with claim 17, characterized in that the recess extends over the central wall area of the first sleeve.

19. A fluorescent lamp in accordance with claim 17, characterized in that the recess is covered with a translucent covering.

* * * * *